United States Patent [19]

Ishikawa et al.

[11] 4,409,324

[45] Oct. 11, 1983

[54] MULTILAYER COLOR PHOTOGRAPHIC LIGHT-SENSITIVE MATERIALS

[75] Inventors: Takatoshi Ishikawa; Akio Mitsui; Masakazu Morigaki; Takashi Nakamura, all of Kanagawa, Japan

[73] Assignee: Fuji Photo Film Co., Ltd., Kanagawa, Japan

[21] Appl. No.: 420,665

[22] Filed: Sep. 21, 1982

[30] Foreign Application Priority Data

Sep. 21, 1981 [JP] Japan ..... 56-149078

[51] Int. Cl.[3] ..... G03C 1/40

[52] U.S. Cl. ..... 430/546; 430/469; 430/487; 430/566

[58] Field of Search ..... 430/469, 487, 546, 566, 430/218

[56] References Cited

U.S. PATENT DOCUMENTS

| | | | |
|---|---|---|---|
| 2,685,516 | 8/1954 | Wilson | 430/487 |
| 2,772,282 | 11/1956 | Allen et al. | 430/469 |
| 4,038,081 | 7/1977 | Habu et al. | 430/487 |
| 4,119,462 | 10/1978 | Hodes | 430/469 |
| 4,310,623 | 1/1982 | Watanabe et al. | 430/546 |
| 4,345,019 | 8/1982 | Kohmura | 430/566 |

*Primary Examiner*—J. Travis Brown

*Attorney, Agent, or Firm*—Sughrue, Mion, Zinn, Macpeak and Seas

[57] ABSTRACT

A multilayer color photographic sensitive material is disclosed. The material is comprised of a support base and a silver halide emulsion layer. The material contains at least one layer containing a high boiling solvent and an oil-soluble coupler, wherein the volume ratio of solvent to coupler is ½ or less, and a compound represented by the general formula (I):

(I)

wherein X is a hydrogen atom or an acetyl group, R is an aryl group, and $R_1$, $R_2$, $R_3$ and $R_4$, which may be the same or different, each represents a hydrogen atom, an alkyl group or an aryl group. The material produces sharp images even though it contains a low oil/coupler ratio. Furthermore, there is no retardation of development.

8 Claims, No Drawings

MULTILAYER COLOR PHOTOGRAPHIC LIGHT-SENSITIVE MATERIALS

FIELD OF THE INVENTION

The present invention relates to silver halide color photographic light-sensitive materials and, particularly, to silver halide multilayer color photographic light-sensitive materials having a low ratio of a high boiling point solvent (oil) to an oil-soluble coupler (hereinafter referred to as oil/coupler ratio).

BACKGROUND OF THE INVENTION

Reducing the oil/coupler ratio is known to be an effective means for improving the sharpness of images or improving the strength of membranes. However, the oil/coupler ratio can only be reduced to a limited extent because it causes a reduction in the rate of development.

Color development accelerators are added to avoid slowing the development caused by the reduction of the oil/coupler ratio. Color development accelerators known hitherto, for example, compounds described in U.S. Pat. Nos. 2,950,970, 2,515,147, 2,496,903, 3,201,242, 4,038,075 and 4,119,462, British Patents 1,430,998 and 1,455,413, Japanese Patent Application (OPI) Nos. 15831/78, 62450/80, 62451/80, 62452/80 and 62453/80 (the term "OPI" as used herein refers to a "published unexamined Japanese patent application") and Japanese Patent Publications Nos. 12422/76 and 49728/80, have been examined. However, the effects of these compounds are not sufficient to eliminate the development retardation caused by the reduced oil/-coupler ratio.

SUMMARY OF THE INVENTION

An object of the present invention is to provide silver halide color photograpic light-sensitive materials having a low oil/coupler ratio (ratio by volume of 0.5 or less).

Another object of the invention is to provide silver halide color photographic light-sensitive materials having a low oil/coupler ratio which can produce images with excellent sharpness. The materials also have strong membranes and do not cause development to be substantially slowed.

As a result of many studies, the present inventors have found that the above described objects can be effectively attained by providing color photographic light-sensitive materials using oil-soluble couplers. The materials are comprised of at least one layer wherein the ratio by volume of high boiling point solvent to oil-soluble coupler is ½ or less and containing a compound represented by the following general formula (I):

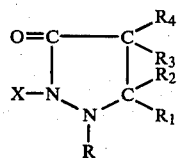

(I)

In the formula, X represents a hydrogen atom or an acetyl group, R represents an aryl group, and $R_1$, $R_2$, $R_3$ and $R_4$ each represents a hydrogen atom, an alkyl group or an aryl group, which may be identical or different from one another.

DETAILED DESCRIPTION OF THE INVENTION

The acetyl group represented by X in the general formula (I) may be substituted. X may be an acetyl group substituted by, for example, an alkyl group having 1 to 4 carbon atoms (a methyl group or an ethyl group, etc.), etc., but it is preferred that X is a hydrogen atom.

Examples of aryl groups represented by R in the general formula (I) include a phenyl group, a naphthyl group, a tolyl group and a xylyl group. Preferred aryl group is a phenyl group. These groups may be substituted. For example, R may be an aryl group substituted by halogen atoms (such as a chlorine or bromine atom), alkyl groups having 1 to 20 carbon atoms (such as a methyl group, ethyl group or propyl group), alkoxy groups having 1 to 20 carbon atoms (such as a methoxy group or ethoxy group), a sulfonyl group or amide groups having 1 to 20 carbon atoms (such as a methylamide group or ethylamide group).

With respect to alkyl groups represented by $R_1$, $R_2$, $R_3$ and $R_4$ in the general formula (I), alkyl groups having 1 to 10 carbon atoms (for example, a methyl group, an ethyl group, a propyl group, a butyl group, etc.) are preferred. These groups may be substituted by substituents such as hydroxyl groups, amino groups or acyloxy groups having 1 to 20 carbon atoms.

With respect to aryl groups represented by $R_1$, $R_2$, $R_3$ and $R_4$ in the general formula (I), it is possible to utilize phenyl groups, naphthyl groups, xylyl groups and tolyl groups. However, phenyl groups are particularly preferred. These aryl groups may be substituted by halogen atoms (such as a chlorine atom or bromine atom), alkyl groups having 1 to 5 carbon atoms (such as a methyl group, ethyl group or propyl group), hydroxy groups, or alkoxy groups having 1 to 5 carbon atoms (such as a methoxy group or ethoxy group).

$R_1$, $R_2$, $R_3$ and $R_4$ are preferably aryl groups or alkyl groups substituted by an acyloxy group. Phenyl groups are particularly preferred. Particularly preferred compounds represented by general formula (I) are those wherein $R_1$ or $R_2$ represents a phenyl group and those wherein $R_3$ or $R_4$ represents an alkyl group having 1 to 5 carbon atoms substituted by an acyloxy group.

Examples of the compounds represented by the general formula (I) used in the present invention include the following compounds.

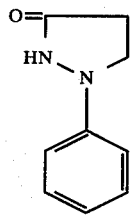

I-1

-continued
I-2
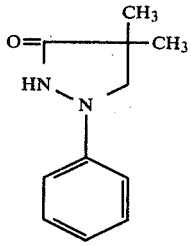
I-3
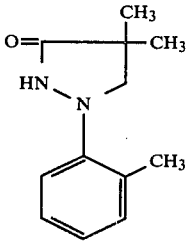
I-4
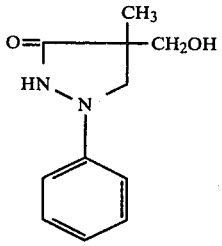
I-5
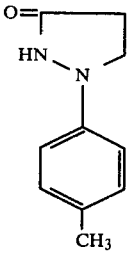
I-6
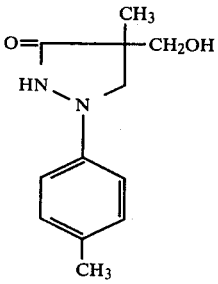
I-7
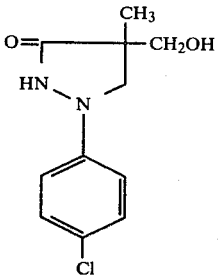
-continued
I-8
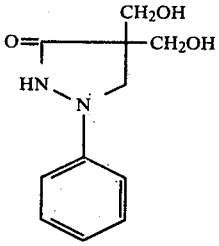
I-9
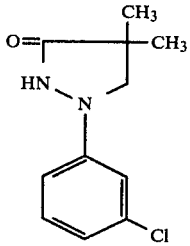
I-10
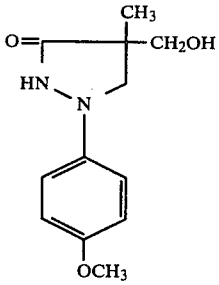
I-11
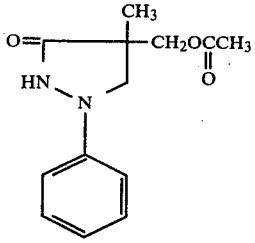
I-12
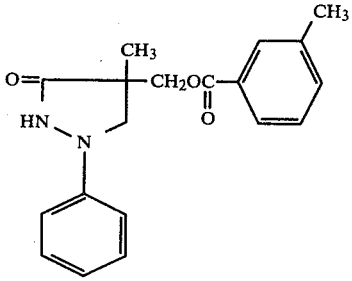
I-13
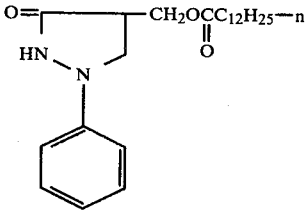

-continued
I-14
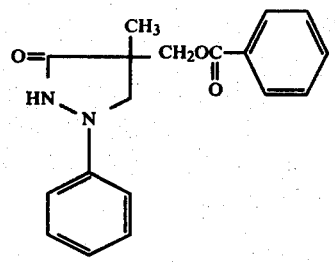
I-15
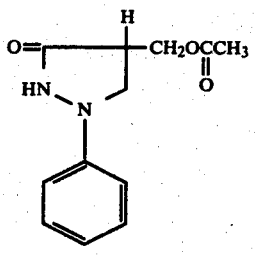
I-16
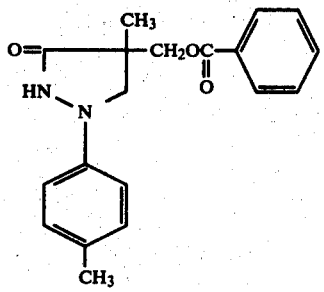
I-17
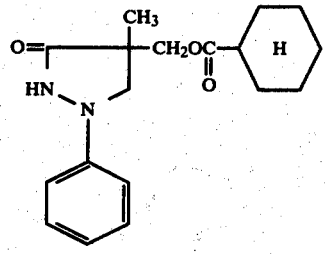
I-18
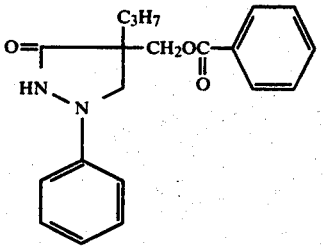
I-19
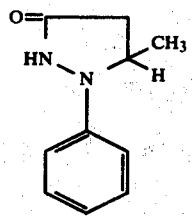
-continued
I-20
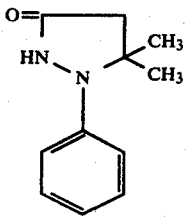
I-21
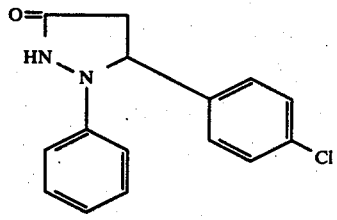
I-22
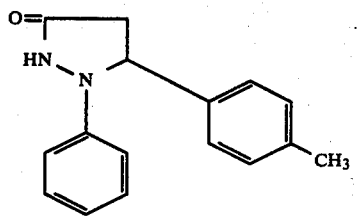
I-23
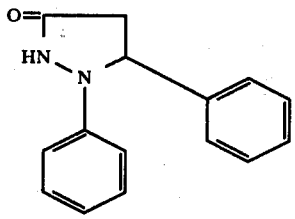
I-24
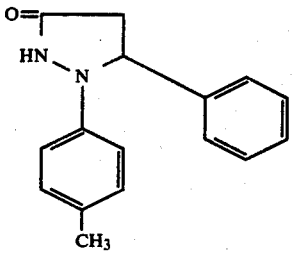
I-25
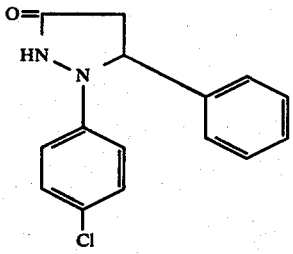

-continued
I-26
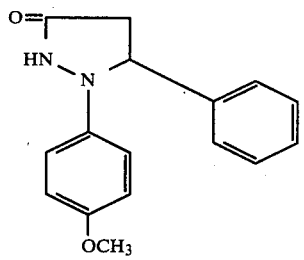
I-27
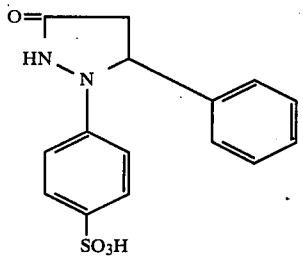
I-28
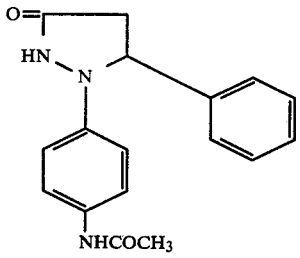
I-29
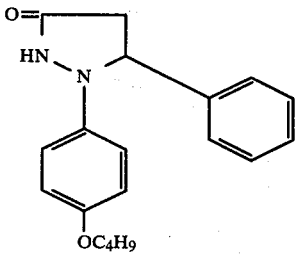
I-30
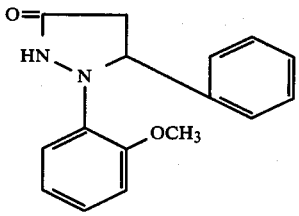
I-31
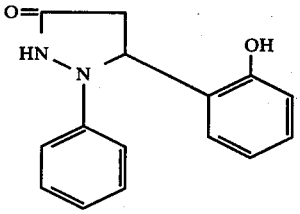
-continued
I-32
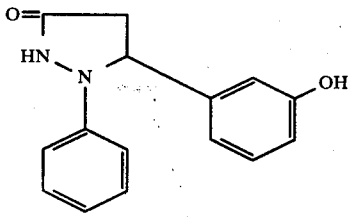
I-33
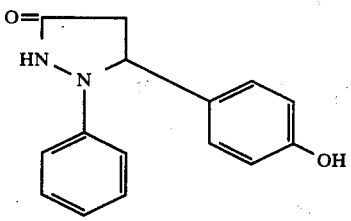
I-34
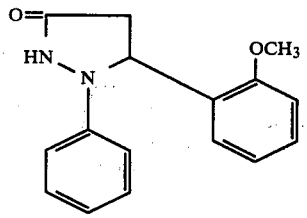
I-35
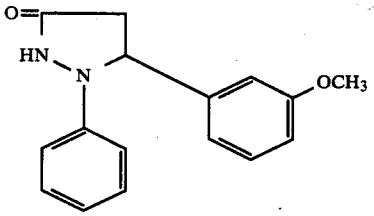
I-36
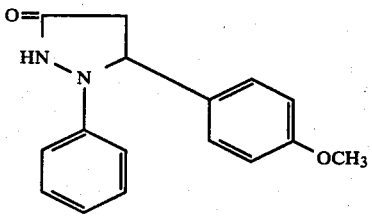
I-37
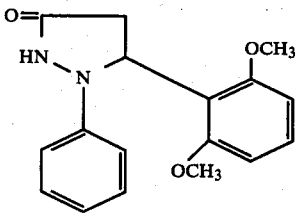
I-38
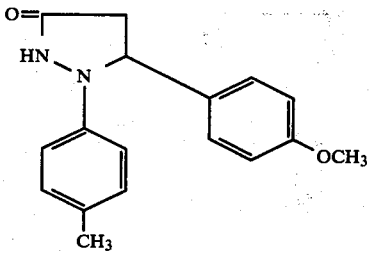

-continued

I-39

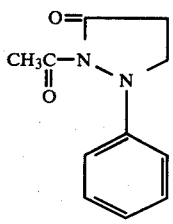

I-40

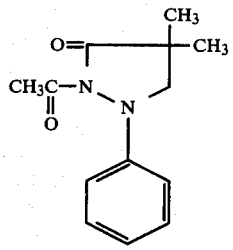

I-41

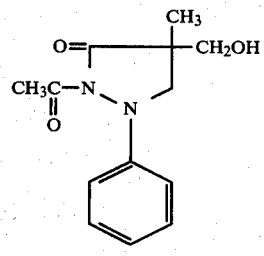

I-42

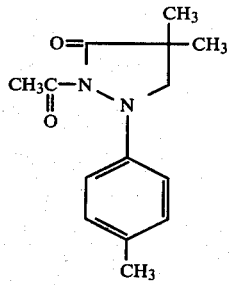

I-43

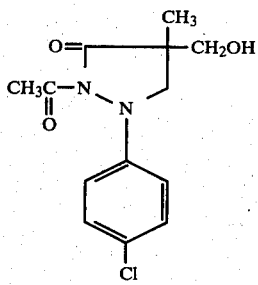

I-44

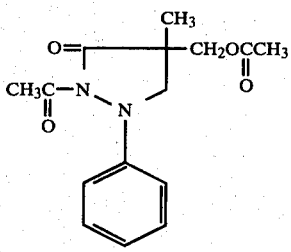

-continued

I-45

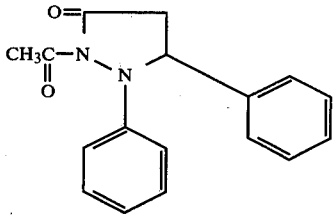

I-46

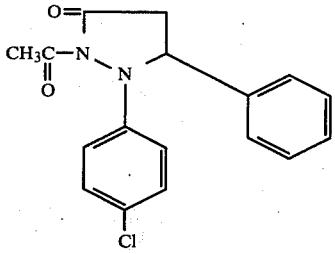

Among the above described compounds, I-13, I-14, I-16, I-17, I-18, I-23, I-24, I-25, I-26, I-34, I-35, I-36 and I-38 are more preferred in the present invention.

Compound (I) is added in an amount of 0.001 mol to 1 mol and, preferably, 0.005 mol to 0.5 mol per mol of silver halide. Compound (I) may be added to any one of the emulsion layers such as the blue sensitive layer, green sensitive layer or red sensitive layer, or may be added to all emulsion layers. It is also possible to add Compound (I) to a layer adjacent to the emulsion layer. It is generally preferred to add Compound (I) to a subbing layer, the lowest layer adjacent to the subbing layer or the lowest of the emulsion layers.

Some of the compounds used in connection with the present invention are commercially available and some can be synthesized according to the processes described in U.S. Pat. Nos. 2,688,024 and 2,704,762 incorporated herein by reference to disclose these processes, and Japanese Patent Application (OPI) No. 64339/81.

Examples for synthesizing typical compounds are described below.

Synthesis 1. (Synthesis of Compound I-12)

To 41.2 g of 4-hydroxymethyl-4-methyl-1-phenyl-3-pyrazolidone in a 1 liter four neck flask, 300 ml of acetonitrile was added. A cooling bath with ice water was used to keep the internal temperature at 10° C., while 31.0 g of benzoyl chloride was slowly added dropwise with stirring in a nitrogen stream. The dropwise addition was completed over a 30 minute period and the bath was removed. After stirred at the room temperature for 3 hours, the mixture was allowed to stand for about 24 hours in a nitrogen atmosphere. After the reaction solution was condensed to dryness, the residue was dissolved in ethyl acetate and washed with a 3% aqueous solution of $NaHCO_3$. The solution was then washed with water and the ethyl acetate phase was dried with Glauber's salt, and condensed to dryness. Thereafter, the residue was crystallized with a methanol/water mixed solvent and then recrystallized with n-hexane/ethyl acetate. Yield: 10.5 g. Melting point: 158.5°–160.0° C.

As a result of NMR, IR measurement and elementary analysis, it was determined that the resulting compound had the desired structure.

Synthesis 2. (Synthesis of Compound I-24)

A mixture of 22.2 g of 4-methylphenylhydrazine hydrochloride, 1.5 g of tert-butylhydroquinone, 67.5 ml of methanol containing 28% of sodium methoxide and 250 ml of n-butanol was stirred with heating in a nitrogen stream. The methanol was then distilled away and 29.6 g of ethyl cinnamate was added dropwise over 30 minutes, and the mixture was stirred with heating for 2 hours while n-butanol was distilled away under an atmospheric pressure. The reacting solution was cooled and then neutralized with an aqueous solution of hydrochloric acid and extracted with ethyl acetate. The extract was washed with water and then dried with anhydrous magnesium sulfate. After the solvent was distilled away, crystallization was carried out with ethyl acetate to obtain 7.7 g of Compound I-24. Melting point: 156°–158° C.

Elementary analysis ($C_{16}H_{16}N_2O$).

Calculation value (%): C: 76.17 H: 6.39 N: 11.10. Found value (%): C: 76.20 H: 6.19 N: 11.07.

Synthesis 3. (Synthesis of Compound I-32)

A mixture of 18 g of phenylhydrazine, 1.0 g of tert-butylhydroquinone, 50.2 ml of methanol containing 28% of sodium methoxide and 250 ml of butanol was stirred with heating in a nitrogen stream. The methanol was distilled away and 100 ml of a solution containing 32 g of ethyl m-hydroxycinnamate in n-butanol was added dropwise over 30 minutes. Stirring was carried out with heating for 3 hours while distilling away the n-butanol under atmospheric pressure. The reacting solution was cooled, neutralized with an aqueous solution of hydrochloride, extracted with n-butanol and washed with a saturated solution of salt. The extract solution was dried with anhydrous magnesium sulfate and the solvent was distilled away. The residue was recrystallized with a solvent mixture of methanol/n-hexane (2/1) to obtain 14.1 g of Compound I-32. Melting point: 188°–189.5° C.

Elementary analysis ($C_{15}H_{14}N_2O_2$)

Calculation value (%): C: 70.85 H: 5.55 N: 11.01 Found value (%): C: 70.84 H: 5.43 N: 11.17

Synthesis 4. (Synthesis of Compound I-35)

A mixture of 19.4 g of phenylhydrazine, 1.6 g of tert-butylhydroquinone, 60.3 ml of methanol containing 28% sodium methoxide and 250 ml of n-butanol was stirred with heating in a nitrogen stream. The methanol was distilled away and then 100 ml of a solution containing 41.2 g of ethyl m-methoxycinnamate in n-butanol was added dropwise over 30 minutes. Stirring with heating was then carried out for 1 hour while distilling away the n-butanol under atmospheric pressure. The reacting solution was cooled and neutralized with an aqueous solution of hydrochloric acid. The solution was extracted with n-butanol, and the extract solution was washed with a saturated solution of salt and dried with anhydrous magnesium sulfate. The solvent was distilled away, and the resulting solid was recrystallized from methanol to obtain 30 g of Compound I-35. Melting point: 164°–166° C.

Elementary analysis ($C_{16}H_{16}N_2O_2$).

Calculation value (%): C: 71.62 H: 6.01 N: 10.44. Found value (%): C: 71.61 H: 5.95 N: 10.56.

In general, any known solvent can be used as the above described oil. However, it is preferable to use a high boiling point solvent, particularly, an organic solvent having a boiling point of 180° C. or more.

For example, it is preferable to use phthalic acid alkyl esters described in U.S. Pat. No. 2,322,027 (dibutyl phthalate and dioctyl phthalate, etc.), phosphoric acid esters (diphenyl phosphate, triphenyl phosphate, tricresyl phosphate and dioctylbutyl phosphate), citric acid esters (for example, tributyl acetylcitrate), benzoic acid esters (for example, octyl benzoate), alkylamides (for example, diethyl laurylamide), aliphatic acid esters (for example, dibutoxyethyl succinate and dioctyl azelate) and trimesic acid esters (for example, tributyl trimesate), etc. Preferred examples of them include those described in U.S. Pat. Nos. 2,322,027, 2,533,514 and 2,835,579, Japanese Patent Publication No. 63233/71, U.S. Pat. No. 3,287,134, British Patent 958,441, Japanese Patent Application (OPI) No. 1031/72, British Patent No. 1,222,753, U.S. Pat. No. 3,936,303, Japanese Patent Application (OPI) Nos. 26037/76 and 82078/77, U.S. Pat. Nos. 2,353,262, 2,852,383, 3,554,755, 3,676,137, 3,676,142, 3,700,454, 3,748,141 and 3,837,863, German Patent Application (OLS) No. 2,538,889, Japanese Patent Application (OPI) Nos. 27921/76, 27922/76, 26035/76, 26036/76, 62632/75, Japanese Patent Publication No. 29461/74, U.S. Pat. Nos. 3,936,303 and 3,748,141 and Japanese Patent Application (OPI) No. 1521/78. However, it should be noted that alkyl phosphates (diphenyl phosphate, triphenyl phosphate, tricresyl phosphate and dioctylbutyl phosphate, etc.) are particularly preferred.

In general, any oil-soluble couplers can be used as the couplers.

Examples of magenta couplers include those described in U.S. Pat. Nos. 2,600,788, 2,983,608, 3,062,653, 3,127,269, 3,311,476, 3,419,391, 3,519,429, 3,558,319, 3,582,322, 3,615,506, 3,834,908 and 3,891,445, German Patent No. 1,810,464, German Patent Application (OLS) Nos. 2,408,665, 2,417,945, 2,418,959 and 2,424,467, Japanese Patent Publication No. 6031/65, Japanese Patent Application (OPI) Nos. 20826/76, 58922/77, 129538/74, 74027/74, 159336/75, 42121/77, 74028/74, 60233/75, 26541/76, 55122/78 and 35858/82.

Preferred yellow couplers include benzoylacetanilide compounds and pivaloylacetanilide compounds. Specific examples of yellow couplers useful in connection with the present invention include those described in U.S. Pat. Nos. 2,875,057, 3,265,506, 3,408,194, 3,551,155, 3,582,322, 3,725,072 and 3,891,445, German Patent No. 1,547,868, German Patent Application (OLS) Nos. 2,219,917, 2,261,361 and 2,414,006, British Patent 1,425,020, Japanese Patent Publication No. 10783/76 and Japanese Patent Application (OPI) Nos. 26133/72, 73147/73, 102636/76, 6341/75, 123342/75, 130442/75, 21827/76, 87650/75, 82424/77 and 115219/77.

Useful cyan couplers include phenol compounds and naphthol compounds. Specific examples of cyan couplers include those described in U.S. Pat. Nos. 2,369,929, 2,434,272, 2,474,293, 2,521,908, 2,895,826, 3,034,892, 3,311,476, 3,458,315, 3,476,563, 3,583,971, 3,591,383, 3,767,411 and 4,004,929, German Patent Application (OLS) Nos. 2,414,830 and 2,454,329, and Japanese Patent Application (OPI) Nos. 59838/73, 26034/76, 5055/73, 146828/76, 69624/77 and 90932/77.

Examples of useful colored couplers are described in, for example, U.S. Pat. Nos. 3,476,560, 2,521,908 and 3,034,892, Japanese Patent Publication Nos. 2016/69, 22335/63, 11304/67 and 32461/69, Japanese Patent Application (OPI) Nos. 26034/76 and 42121/77 and German Patent Application (OLS) No. 2,418,959.

Examples of useful DIR couplers are described in, for example, U.S. Pat. Nos. 3,227,554, 3,617,291, 3,701,783, 3,790,384 and 3,632,345, German Patent Application (OLS) Nos. 2,414,006, 2,454,301 and 2,454,329, British Patent 953,454, Japanese Patent Application (OPI) Nos. 69624/77 and 122335/74 and Japanese Patent Publication No. 16141/76.

The sensitive materials used in the present invention may contain compounds which release a restrainer upon development in addition to the DIR couplers. For Example, it is possible to use compounds described in U.S. Pat. Nos. 3,297,445 and 3,379,529, German Patent Application (OLS) No. 2,417,914 and Japanese Patent Application (OPI) Nos. 15271/77 and 9116/78.

Two or more of the above described couplers may be contained in the same layer. The same coupler may be contained in two or more different layers.

These couplers are generally added in an amount of $2\times10^{-3}$ mol to $5\times10^{-1}$ mol and, preferably $1\times10^{-2}$ mol to $5\times10^{-1}$ mol, per mol of silver in the emulsion layer.

In order to improve sharpness of images and strength of membranes, it is necessary to have at least one layer having an oil/coupler ratio of 0.5 or less.

A preferred oil/coupler ratio is in the range of 0.1 to 0.5.

In order to introduce the above described couplers or 1-phenyl-3-pyrazolidone derivatives into hydrophilic colloid layers, a method described in U.S. Pat. No. 2,322,027 may be used while using the above described high boiling point organic solvents. Alternatively, the above described couplers or derivatives may be dispersed in the hydrophilic colloid after being dissolved in an organic solvent having a boiling point of about 30° C. to 150° C. such as lower alkyl acetate such as ethyl acetate or butyl acetate, ethyl propionate, secondary butyl alcohol, methyl isobutyl ketone, β-ethoxyethyl acetate or methyl cellosolve acetate. The above described high boiling point organic solvents and the low boiling point organic solvents may be used in various mixtures.

It is also possible to use a method of dispersing using polymers described in Japanese Patent Publication No. 39853/76 and Japanese Patent Application (OPI) No. 59943/76.

When the couplers have acid groups such as sulfonic acid or carboxylic acid groups, they are introduced in the form of an aqueous alkaline solution into the hydrophilic colloid.

Further, 1-phenyl-3-pyrazolidones can be dispersed in the emulsion by substitution or can be dispersed in gelatin or the emulsion after being dissolved in water or alcohol.

The subbing layer of the photographic sensitive materials of the present invention is a hydrophilic colloid layer composed of hydrophilic high polymers such as gelatin. Similar polymers are used as the binder of the photographic emulsions or as a protective colloid. Generally, by providing the subbing layer, it is possible to improve adhesion to the photographic emulsion layer or prevent halation.

The color photographic sensitive materials used in the present invention are applicable to any color photographic sensitive materials utilizing color development processing, such as color papers, color negative films or color reversal films. They are particularly useful in connection with printing sensitive materials such as color papers.

The photographic emulsions used in the present invention can be prepared by processes described in *Chimie et Physique Photographique,* written by P. Glafkides (Paul Montel Co., 1967); *Photographic Emulsion Chemistry,* written by G. F. Duffin (The Focal Press, 1966); and *Making and Coating Photographic Emulsion,* written by V. L. Zelikman et al. (The Focal Press, 1964), etc. An acid process, neutral process or ammonia process may be used. In general, any process can be used for reacting soluble silver salts with soluble halogen salts, such as a one-side mixing process, a simultaneous mixing process or a combination thereof.

It is possible to use a process for forming silver halide grains in the presence of an excess amount of silver ions (the so-called reversal mixing process).

It is possible to use a simultaneous mixing process. For example, it is possible to use a process wherein the pAg of the liquid phase, where silver halide is formed, is kept at a constant value, namely, the so-called controlled double jet process. According to this process, silver halide emulsion having a regular crystal form and a nearly uniform particle size can be produced.

Two or more silver halide emulsions prepared separately may be used in a mixture.

Useful silver halides include any silver bromide, silver iodobromide, silver iodochlorobromide, silver bromochloride or silver chloride.

Formation of silver halide particles or physical ageing thereof may be carried out in the presence of cadmium salts, zinc salts, lead salts, thallium salts, iridium salts or complex salts thereof, rhodium salts or complex salts thereof, or iron salts or complex salts thereof, etc.

The photographic emulsions used in the present invention may be spectrally sensitized with methine dyes or others. Examples of useful dyes include cyanine dyes, merocyanine dyes, complex cyanine dyes, complex merocyanine dyes, holopolar cyanine dyes, hemicyanine dyes, styryl dyes and hemioxonol dyes. Particularly useful dyes are cyanine dyes, merocyanine dyes and complex compound cyanine dyes. In these dyes, any nucleus conventionally utilized in cyanine dyes as a basic heterocyclic nucleus can be applied. Namely, it is possible to apply a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus and a pyridine nucleus, etc.; the above described nuclei to which aliphatic hydrocarbon rings are fused; and the above described nuclei to which aromatic hydrocarbon rings are fused, such as an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus and a quinoline nucleus. These nuclei may be substituted on a carbon atom.

In the merocyanine dyes and the complex merocyanine dyes, it is possible to apply 5- or 6-membered heterocyclic nuclei as nuclei having a ketomethylene, such as a pyrazolin-5-one nucleus, a thiohydantoin nucleus, a 2-thioxazoline-2,4-dione nucleus, a thiazolidine-2,4-dione nucleus, a rhodanine nucleus or a thiobarbituric acid nucleus.

Examples of useful sensitizing dyes include those described in German Patent No. 929,080, U.S. Pat. Nos. 2,231,658, 2,493,748, 2,503,776, 2,519,001, 2,912,329, 3,656,959, 3,672,897, 3,694,217, 4,025,349 and 4,046,572, British Pat. No. 1,242,588 and Japanese Patent Publication Nos. 14030/69 and 24844/77.

These sensitizing dyes may be used alone or in combinations. A combination of sensitizing dyes is frequently used for the purpose of supersensitization. Examples of the combinations include those described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862 and 4,026,707, British Pat. Nos. 1,344,281 and 1,507,803, Japanese Patent Publication Nos. 4936/68 and 12375/78 and Japanese Patent Application (OPI) Nos. 110618/77 and 109925/77.

The emulsions may contain dyes which do not have a spectral sensitization function themselves or substances which do not substantially absorb visible light, which show a supersensitization function, together with the sensitizing dyes. For example, the emulsions may contain aminostilbene compounds substituted by nitrogen containing heterocyclic groups (for example, those described in U.S. Pat. Nos. 2,933,390 and 3,635,721), condensation products of aromatic organic acid and formaldehyde (for example, those described in U.S. Pat. No. 3,743,510), cadmium salts and azaindene compounds, etc. Combinations described in U.S. Pat. Nos. 3,615,613, 3,615,641, 3,617,295 and 3,635,721 are particularly useful.

Gelatin is preferably used as the binder of the photographic emulsions or a protective colloid, but other hydrophilic colloids can be used.

For example, it is possible to use proteins such as gelatin derivatives, graft polymers of gelatin with other high polymers, albumin or casein; saccharides such as cellulose derivatives such as hydroxyethyl cellulose, carboxymethyl cellulose or cellulose sulfates, sodium alginate, or starch derivatives; and various synthetic hydrophilic high molecular substances such as homo- or copolymers such as polyvinyl alcohol, polyvinyl alcohol partial acetal, poly-N-vinylpyrrolidone, polyacrylic acid, polymethacrylic acid, polyacrylamide, polyvinylimidazole or polyvinylpyrazole.

Useful gelatins include lime treated gelatin as well as acid treated gelatin and enzyme treated gelatin described in *Bull. Soc. Sci. Phot. Japan,* No. 16, page 30 (1966) may be used. In addition, hydrolyzed products and enzymatic decomposition products of gelatin can be used. Useful gelatin derivatives include those which are prepared by reacting gelatin with various compounds, for example, acid halides, acid anhydrides, isocyanates, bromoacetic acid, alkane sultones, vinylsulfonamides, maleinimide compounds, polyalkylene oxides and epoxy compounds. Specific examples of such derivatives are described in U.S. Pat. Nos. 2,614,928, 3,132,945, 3,186,846 and 3,312,553, British Pat. Nos. 861,414, 1,033,189 and 1,005,784 and Japanese Patent Publication No. 26845/67.

Useful gelatin graft polymers include those which are prepared by grafting a homo- or copolymer of vinyl monomers such as acrylic acid, methacrylic acid, and derivatives thereof such as esters or amides, etc., acrylonitrile or styrene, etc., on gelatin. It is particularly preferred to use graft polymers composed of gelatin and a polymer having some degree of compatibility with gelatin, such as polymers of acrylic acid, methacrylic acid, acrylamide, methacrylamide or hydroxyalkyl methacrylate. Examples of them include those described in U.S. Pat. Nos. 2,763,625, 2,831,767 and 2,956,884.

Examples of typical synthetic hydrophilic high molecular substances include those described in German Patent Application (OLS) No. 2,312,708, U.S. Pat. Nos. 3,620,751 and 3,879,205 and Japanese Patent Publication No. 7561/68.

The present invention can be applied to multilayer multicolor photographic materials having at least three layers having each a different spectral sensitivity on a base. The multilayer natural color photographic material generally has at least one red-sensitive emulsion layer, one green-sensitive emulsion layer and one blue-sensitive emulsion layer, respectively, on a base. The order of these layers can be suitably determined as occasion demands. Generally, the red-sensitive emulsion layer contains a cyan forming coupler, the green-sensitive emulsion layer contains a magenta forming coupler and the blue-sensitive emulsion layer contains a yellow forming coupler, but, if necessary, another combinations can be utilized.

In photographic sensitive materials prepared by the present invention, hydrophilic colloid layers may contain water-soluble dyes as filter layers or for the purpose of preventing irradiation or other purposes. Such dyes include oxonol dyes, hemioxonol dyes, styryl dyes, merocyanine dyes, cyanine dyes and azo dyes. Among them, oxonol dyes, hemioxonol dyes and merocyanine dyes are particularly advantageous. Examples of useful dyes include those described in British Pat. Nos. 584,609 and 1,177,429, Japanese Patent Application (OPI) Nos. 85130/73, 99620/74, 114420/74 and 108115/77, and U.S. Pat. Nos. 2,274,782, 2,533,472, 2,956,879, 3,148,187, 3,177,078, 3,247,127, 3,540,887, 3,575,704, 3,653,905, 3,718,472, 4,071,312 and 4,070,352.

In carrying out the present invention, the following known antifading agents can be used together. Further, the color image stabilizers used in the present invention can be used alone or as a mixture of two or more of them. Examples of known antifading agents include hydroquinone derivatives described in U.S. Pat. Nos. 2,360,290, 2,418,613, 2,675,314, 2,701,197, 2,704,713, 2,728,659, 2,732,300, 2,735,765, 2,710,801 and 2,816,028, and British Pat. No. 1,363,921; gallic acid derivatives described in U.S. Pat. Nos. 3,457,079 and 3,069,262; p-alkoxyphenols described in U.S. Pat. Nos. 2,735,765 and 3,698,909 and Japanese Patent Publication Nos. 20977/74 and 6623/77; p-oxyphenol derivatives described in U.S. Pat. Nos. 3,432,300, 3,573,050, 3,574,627 and 3,764,337 and Japanese Patent Application (OPI) Nos. 35633/77, 147434/77 and 152225/77; and bisphenols described in U.S. Pat. No. 3,700,455.

The sensitive materials produced by the present invention may contain hydroquinone derivatives, aminophenol derivatives, gallic acid derivatives and ascorbic acid derivatives, etc., as anti-color-foggants. Examples of them have been described in U.S. Pat. Nos. 2,360,290, 2,336,327, 2,403,721, 2,418,613, 2,675,314, 2,701,197, 2,704,713, 2,728,659, 2,732,300 and 2,735,765, Japanese Patent Application (OPI) Nos. 92988/75, 92989/75, 93928/75, 110337/75 and 146235/77 and Japanese Patent Publication No. 23813/75.

In the sensitive materials produced by the present invention, the hydrophilic colloid layers may contain ultraviolet ray absorbing agents. For example, it is possible to use benzotriazole compounds substituted by an aryl group (for example, those described in U.S. Pat. No. 3,533,794), 4-thiazolidone compounds (for example, those described in U.S. Pat. Nos. 3,314,794 and 3,352,681), benzophenone compounds (for example, those described in U.S. Pat. Nos. 3,705,805 and 3,707,375), butadiene compounds (for example, those described in U.S. Pat. No. 4,045,229), and benzoxazole compounds (for example, those described in U.S. Pat. No. 3,700,455). Further, it is possible to use those described in U.S. Pat. No. 3,499,762 and Japanese Patent Application (OPI) No. 48535/79. Ultraviolet ray absorbing couplers (for example, α-naphthol cyan dye forming couplers) and ultraviolet ray absorbing polymers may be used. These ultraviolet ray absorbing agents may be mordanted in a specified layer.

In the sensitive materials produced by the present invention, the photographic emulsion layers and other hydrophilic colloid layers may contain whitening agents such as stilbene, triazine, oxazole or coumarin whitening agents. They may be water-soluble ones. Water-insoluble whitening agents may be used as a state of dispersion. Examples of the fluorescent whitening agents have been described in U.S. Pat. Nos. 2,632,701, 3,269,840 and 3,359,102 and British Pat. Nos. 852,075 and 1,319,763.

In the photographic sensitive materials of the present invention, the photographic emulsion layers and other hydrophilic colloid layers can be provided on a base or another layer by various known methods. Coating can be carried out by a dip coating method, a roller coating method, a curtain coating method or an extrusion coating method. Methods described in U.S. Pat. Nos. 2,681,294, 2,761,791 and 3,526,528 are advantageously utilized.

Photographic processing of the sensitive materials of the present invention can be carried out by known methods. Known treating solution can be used. The treating temperature is generally selected from a range of from 18° C. to 50° C., but a temperature lower than 18° C. and a temperature higher than 50° C. may be used. Any color development processing can be applied for forming dye images.

The color developing solution is generally composed of an alkaline aqueous solution containing a color developing agent. Useful color developing agents include known primary aromatic amine developing agents, for example, phenylenediamines (for example, 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfonamidoethylaniline and 4-amino-3-methyl-N-ethyl-N-β-methoxyethylaniline).

In addition, substances described in *Photographic Processing Chemistry,* written by F. A. Mason, pages 226 to 229 (Focal Press, 1966) and U.S. Pat. Nos. 2,193,015 and 2,592,364 and Japanese Patent Application (OPI) No. 64933/73 may be used.

The color developing solution may contain a pH buffering agent such as sulfites, carbonates, borates or phosphates of alkali metals, and a development restrainer or an antifogging agent such as bromides, iodides or organic antifoggants, etc., besides the above described agents. Further, it may contain, if desired, a water softener, a preservatives such as hydroxylamine, an organic solvent such as benzyl alcohol or diethylene glycol, a development accelerator such as polyethylene glycol, quaternary ammonium salts or amines, a dye forming coupler, a competition coupler, a fogging agent such as sodium borohydride, a thickener, a polycarboxylic acid chelating agent described in U.S. Pat. No. 4,083,723 and an antioxidant described in German Patent Application (OLS) No. 2,622,950, etc.

Generally, the photographic emulsion layers after color development are subjected to bleach processing. The bleach processing may be carried out simultaneously with fixation processing. As a bleaching agent, polyvalent metal compounds such as those of iron (III), cobalt (III), chromium (VI) or copper (II), etc., peracids, quinones and nitroso compounds, etc., may be used. For example, it is possible to use ferricyanides, bichromates, organic complex salts of iron (III) or cobalt (III), for example, complex salts of organic acids such as aminopolycarboxylic acids (such as ethylenediaminetetraacetic acid, nitrilotriacetic acid or 1,3-diamino-2-propanol tetraacetic acid, etc.), citric acid, tartaric acid and malic acid, etc., persulfates, permanganates, and nitrosophenol, etc. Among them, potassium ferricyanide, sodium ethylenediaminetetraacetate iron (III) and ammonium ethylenediaminetetraacetate iron (III) are particularly useful. Ethylenediaminetetraacetate iron (III) complexes are useful in both the bleaching solution and the one-bath bleach-fixing solution.

To the bleaching solution or the bleach-fixing solution, it is possible to add bleaching accelerators described in U.S. Pat. Nos. 3,042,520 and 3,241,966 and Japanese Patent Publication Nos. 8506/70 and 8836/70, thiol compounds described in Japanese Patent Application (OPI) No. 65732/78, and other various additives.

The sensitive materials produced by the present invention may be treated with a developing solution which is supplied or controlled by methods described in Japanese Patent Application (OPI) Nos. 84636/76, 119934/77, 46732/78, 9626/79, 19741/79, 37731/79, 1048/81, 1049/81 and 27142/81.

The bleach-fixing solution used for the sensitive materials produced by the present invention may be regenerated by the methods described in Japanese Patent Application (OPI) Nos. 781/71, 49437/73, 18191/73, 145231/75, 18541/76, 19535/76 and 144620/76 and Japanese Patent Publication No. 23178/76.

EXAMPLE 1

To a paper base the both sides of which were laminated with polyethylene, the following first layer (the lowest layer) to the sixth layer (the top layer) were applied to produce a multilayer color sensitive material A. (In the following, mg/m$^2$ represents the amount coated.)

| | |
|---|---|
| The 6th layer (protective layer) | Gelatin 1,500 mg/m$^2$ |
| The 5th layer (red-sensitive layer) | Silver chlorobromide emulsion (silver bromide 50% by mol, silver 250 mg/m$^2$)<br>Gelatin 1,500 mg/m$^2$<br>Cyan coupler (*1) 500 mg/m$^2$<br>Coupler solvent (*2) 250 mg/m$^2$ |
| The 4th layer (ultraviolet ray absorbing layer) | Gelatin 1,200 mg/m$^2$<br>Ultraviolet ray absorbing agent (*3) 700 mg/m$^2$<br>Solvent for the ultraviolet ray absorbing agent (*2) 250 mg/m$^2$ |
| The 3rd layer (green-sensitive layer) | Silver chlorobromide emulsion (silver bromide 70% by mol, silver 350 mg/m$^2$)<br>Gelatin 1,500 mg/m$^2$<br>Magenta coupler (*4) 400 mg/m$^2$<br>Coupler solvent (*5) 400 mg/m$^2$ |
| The 2nd layer (intermediate layer) | Gelatin 1,000 mg/m$^2$ |
| The 1st layer | Silver chlorobromide (silver bromide |

-continued

| | |
|---|---|
| (blue-sensitive layer) | 80% by mol, silver 350 mg/m$^2$)<br>Gelatin 1,500 mg/m$^2$<br>Yellow coupler (*6) 500 mg/m$^2$<br>Coupler solvent (*2) 500 mg/m$^2$ |
| Base | Polyethylene laminated paper (polyethylene in the 1st layer side contains white pigments ($TiO_2$, etc.) and blue dyes (ultramarine, etc.)) |

(*1) Cyan coupler: 2-[α-(2,4-di-t-amylphenoxy)butanamide]-4,6-dichloro-5-methylphenol
(*2) Coupler solvent: Trinonyl phosphate
(*3) Ultraviolet ray absorbing agent: 2-(2-Hydroxy-3-sec-butyl-5-t-butylphenyl)benzotriazole
(*4) Magenta coupler: 1-(2,4,6-Trichlorophenyl)-3-(2-chloro-5-tetradecanamide)anilino-2-pyrazolino-5-one
(*5) Coupler solvent: o-Cresyl phosphate
(*6) Yellow coupler: α-Pivaloyl-α-(2,4-dioxo-5,5-dimethyl-oxazolidin-3-yl)-2-chloro-5-[α-(2,4-di-t-amylphenoxy)butanamide]-acetanilide Sample C was prepared by the same manner as in Sample A except that the coupler solvent in the 1st layer was present in an amount of 100 mg/m$^2$. Samples B and D were prepared by the same manner as in Samples A and C, respectively, except that the Compound I-23 of the present invention was dissolved in the coupler solvent together with the yellow coupler and applied in an amount of 20 mg/m$^2$. Samples E to H were prepared by the same manner as in Samples A to D, respectively, except that dibutyl phthalate was used as the coupler solvent instead of trinonyl phosphate.

After the above described sensitive materials were exposed to light through an optical wedge, they were treated in the following steps.

| Processing Step (33° C.) | |
|---|---|
| Color development | 15 sec to 3 min and 30 sec |
| Bleach-fixation | 1 min and 30 sec |
| Water wash | 3 min |
| Drying | 10 min |

The composition of each processing solution was as follows.

| Color Developing Solution | |
|---|---|
| Benzyl alcohol | 12 ml |
| Diethylene glycol | 5 ml |
| Potassium carbonate | 25 g |
| Sodium chloride | 0.1 g |
| Sodium bromide | 0.5 g |
| Anhydrous sodium sulfite | 2 g |
| Hydroxylamine sulfate | 2 g |
| Fluorescent whitening agent | 1 g |
| N—Ethyl-N—β-methanesulfonamidoethyl-3-methyl-4-aminoaniline sulfate | 4 g |

Water was added to make 1 liter and NaOH was added to make a pH of 10.

| Bleach-Fixing Solution | |
|---|---|
| Ammonium thiosulfate | 124.5 g |
| Sodium metabisulfite | 13.3 g |
| Anhydrous sodium sulfite | 2.7 g |
| EDTA iron (III) ammonium salt | 65 g |
| Color developing solution (described above) | 100 ml |

The pH was adjusted to 6.7–6.8.
Water was added to make 1 liter.

Then, light reflection densities of yellow, magenta and cyan were measured by a Fuji automatic densitometer.

The maximum density of yellow density which showed a large development retard was shown in Table 1.

TABLE 1

| Sample | Blue-Sensitive Layer Solvent | Oil/Coupler Ratio | Compound I-23 | $D_{max}$ 15" | 30" | 1'00" | 3'30" |
|---|---|---|---|---|---|---|---|
| A | Trinonyl phosphate | 1.0 | — | 0.30 | 1.03 | 1.81 | 2.20 |
| B | Trinonyl phosphate | 1.0 | 20 mg/m$^2$ | 1.06 | 1.54 | 1.98 | 2.21 |
| C | Trinonyl phosphate | 0.2 | — | 0.12 | 0.74 | 1.50 | 2.01 |
| D | Trinonyl phosphate | 0.2 | 20 mg/m$^2$ | 1.03 | 1.51 | 1.95 | 2.21 |
| E | Dibutyl phthalate | 1.0 | — | 0.32 | 1.06 | 1.84 | 2.21 |
| F | Dibutyl phthalate | 1.0 | 20 mg/m$^2$ | 1.08 | 1.52 | 1.99 | 2.20 |
| G | Dibutyl phthalate | 0.2 | — | 0.11 | 0.72 | 1.51 | 2.10 |
| H | Dibutyl phthalate | 0.2 | 20 mg/m$^2$ | 1.06 | 1.50 | 1.95 | 2.20 |

Table 1 clearly shows that development retardation is observed, if the amount of the coupler solvent is reduced. However, when Compound I-23 is present, development retard is not observed and a sufficient development acceleration effect and a sufficient color density are obtained, if the amount of the coupler solvent is reduced.

Further, Samples B' and D' were prepared by the same manner as in the above described Samples B and D, except that the Compound I-23 was not used.

Samples B' and D' were exposed to light and subjected to development using the above described color developing solution to which 1,8-dihydroxy-3,6-dithiaoctane (compound described in U.S. Pat. No. 3,201,242) was added as a color development accelerator, and densities were measured.

Results obtained are shown in Table 2.

TABLE 2

| Sample | Blue-Sensitive Layer Solvent | Oil/Coupler Ratio | 1,8-Dihydroxy-3,6-dithiaoctane | $D_{max}$ 15" | 30" | 1'00" | 3'30" |
|---|---|---|---|---|---|---|---|
| A | Trinonyl-phosphate | 1.0 | — | 0.30 | 1.03 | 1.81 | 2.20 |
| B' | Trinonyl-phosphate | 1.0 | 1.0 g/l | 0.45 | 1.24 | 2.05 | 2.21 |
| C | Trinonyl-phosphate | 0.2 | — | 0.12 | 0.74 | 1.50 | 2.01 |
| D' | Trinonyl-phosphate | 0.2 | 1.0 g/l | 0.28 | 0.95 | 1.72 | 2.15 |

When using the above described development accelerator, a development acceleration effect was observed when the oil/coupler ratio was reduced. However, development accelerator was not sufficient to completely compensate for the development retardation as shown with respect to Comparison Samples B′ and D′.

EXAMPLE 2

Samples were produced with using Compounds I-1, I-4, I-14 and I-24 instead of Compound I-23 in Example 1, and they were examined by the same manner as in Example 1. The amount of each compound was 20 mg/m$^2$.

The development retardation caused by reduction of the oil/coupler ratio was not observed when using any of the above described compounds, and sufficient density could be obtained.

While the invention has been described in detail and with reference to specific embodiments thereof, it will be apparent to one skilled in the art that various changes and modifications can be made therein without departing from the spirit and scope thereof.

What is claimed is:

1. A multi-layered color photographic sensitive material, comprising:

a support base;

a silver halide emulsion layer; and a layer containing a high boiling solvent and an oil-soluble coupler, wherein the volume ratio of solvent to coupler is ½ or less, and a compound represented by the general formula (I):

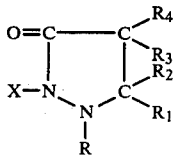

(I)

wherein X is a hydrogen atom or an acetyl group, R is an aryl group, and $R_1$, $R_2$, $R_3$ and $R_4$, which may be the same or different, each represents a hydrogen atom, an alkyl group or an aryl group.

2. A multi-layered color photographic sensitive material as claimed in claim 1, wherein $R_1$ or $R_2$ represents a phenyl group.

3. A multi-layered color photographic sensitive material as claimed in any of claims 1 or 2, wherein $R_3$ or $R_4$ represents an alkyl group substituted by an acyloxy group.

4. A multi-layered color photographic sensitive material as claimed in claim 3, wherein the compound represented by the general formula (I) is present in an amount of 0.001 mol to 1 mol per mol of silver halide.

5. A multi-layered color photographic sensitive material as claimed in claim 4, wherein the compound represented by the general formula (I) is present in an amount of 0.005 mol to 0.5 mol per mol of silver halide.

6. A multi-layered color photographic sensitive material as claimed in claim 1, wherein the volume ratio of solvent to coupler is in the range of 0.1 to 0.5.

7. A multi-layered color photographic sensitive material as claimed in claim 1, wherein $R_1$, $R_2$, $R_3$ and $R_4$ represent alkyl groups containing 1 to 10 carbon atoms.

8. A multi-layered color photograpic sensitive material as claimed in claim 1, wherein the high boiling solvent is an organic solvent having a boiling point of 180° C. or more.

* * * * *